US006035556A

United States Patent [19]

Ballinger et al.

[11] Patent Number: 6,035,556

[45] Date of Patent: Mar. 14, 2000

[54] SHOE CLOSURE MECHANISM

[76] Inventors: Shannon K. Ballinger; Mike A. Reeder, both of 3831 SW. Southpark Ave., A47, Topeka, Kans. 66609

[21] Appl. No.: 09/283,805

[22] Filed: Apr. 1, 1999

[51] Int. Cl.[7] ..... A43C 11/12; A43C 11/00

[52] U.S. Cl. ..... 36/50.1; 36/50.5; 36/118.1; 36/117.6

[58] Field of Search ..... 36/118.1, 50.1, 36/50.5, 117.6, 117.7, 117.8, 117.9

[56] References Cited

U.S. PATENT DOCUMENTS

| | | | |
|---|---|---|---|
| 3,589,038 | 6/1971 | Sailer | 36/50 |
| 4,160,332 | 7/1979 | Salomon | 36/119 |
| 4,338,735 | 7/1982 | Spademan | 36/119 |
| 4,426,796 | 1/1984 | Spademan | 36/119 |
| 4,494,324 | 1/1985 | Spademan | 36/119 |
| 4,631,843 | 12/1986 | Annovi | 36/119 |
| 4,924,605 | 5/1990 | Spademan | 36/114 |
| 5,341,583 | 8/1994 | Hallenbeck | 36/50.1 |
| 5,467,537 | 11/1995 | Aveni et al. | 36/50.1 |
| 5,555,650 | 9/1996 | Longbottom et al. | 36/114 |
| 5,572,774 | 11/1996 | Duren | 24/306 |
| 5,704,138 | 1/1998 | Donnadieu | 36/58.5 |
| 5,737,854 | 4/1998 | Sussmann | 36/50.1 |

FOREIGN PATENT DOCUMENTS

| | | | |
|---|---|---|---|
| 3821053 | 1/1989 | Germany | 36/50.5 |
| 81/01645 | 6/1981 | WIPO | 36/118.1 |

*Primary Examiner*—Paul T. Sewell
*Assistant Examiner*—Anthony Stashick
*Attorney, Agent, or Firm*—Joseph N. Breaux

[57] ABSTRACT

A shoe closure mechanism that uses the weight of the user's foot to close two pivoting closure arms secured to the flaps of the shoe. The shoe closure mechanism includes a curved, shape returning, foot surround member with a central saddle back section positioned between two curved connecting ends, two pivoting closure arms each connected together at the bottom ends thereof with a pivot assembly and each connected at a top end thereof to one curved connecting end of the curved foot surround member. When the user places his/her foot through the foot surround member and places weight onto the central saddle back section, the saddle back section is straightened out forcing the two curved connecting ends together along with the two pivoting closure arms. The pivoting closure arms are automatically locked in the closed position by a locking mechanism including a spring biased locking bar.

1 Claim, 2 Drawing Sheets

SHOE CLOSURE MECHANISM

TECHNICAL FIELD

The present invention relates to shoe closure devices and more particularly to a shoe closure mechanism that uses the weight of the user's foot to close two pivoting closure arms secured to the flaps of the shoe; the shoe closure mechanism including a curved, shape returning, foot surround member with a central saddle back section positioned between two curved connecting ends, two pivoting closure arms each having an angled locking tooth extending from an undersurface thereof having an angled face and a perpendicular face and being connected together at the bottom ends thereof with a pivot assembly and each connected at a top end thereof to one curved connecting end of the curved foot surround member, and a locking mechanism that includes a spring biased locking bar having two sets of oppositely slanted teeth each positioned to engage one of the locking tooth of the pivoting closure arm, each set of slanted teeth being slanted such that the slanted surfaces face the angle face of its respective locking tooth allowing the closure arm to move toward a closed position; the top ends of the pivoting closure arms being forced together when the central saddle back portion is straightened; the locking mechanism disengaging the two locking teeth from the slanted teeth of the spring biased locking bar when a force is applied to a release button attached to the spring biased locking bar in a direction to move the spring biased locking bar away from the pivoting closure arms.

BACKGROUND ART

It is often difficult for children and infirm individuals to tie shoes. It would be a benefit, therefore, to have a shoe closure system that could be installed in shoes that included a mechanism for automatically closing closure arms to which the flaps of a shoe can be secured and that included an easily operated locking mechanism for locking the closure arms in the closed position.

GENERAL SUMMARY DISCUSSION OF INVENTION

It is thus an object of the invention to provide a shoe closure mechanism that includes a mechanism for automatically closing closure arms to which the flaps of a shoe can be secured.

It is a further object of the invention to provide a shoe closure mechanism that includes an easily operated locking mechanism for locking a pair of pivoting closure arms in a closed position.

It is a still further object of the invention to provide a shoe closure mechanism that includes a curved, shape returning, foot surround member with a central saddle back section positioned between two curved connecting ends, two pivoting closure arms each having an angled locking tooth extending from an undersurface thereof having an angled face and a perpendicular face and being connected together at the bottom ends thereof with a pivot assembly and each connected at a top end thereof to one curved connecting end of the curved foot surround member, and a locking mechanism that includes a spring biased locking bar having two sets of oppositely slanted teeth each positioned to engage one of the locking tooth of the pivoting closure arm, each set of slanted teeth being slanted such that the slanted surfaces face the angle face of its respective locking tooth allowing the closure arm to move toward a closed position; the top ends of the pivoting closure arms being forced together when the central saddle back portion is straightened; the locking mechanism disengaging the two locking teeth from the slanted teeth of the spring biased locking bar when a force is applied to a release button attached to the spring biased locking bar in a direction to move the spring biased locking bar away from the pivoting closure arms.

It is a still further object of the invention to provide a shoe closure mechanism that accomplishes all or some of the above objects in combination.

Accordingly, a shoe closure mechanism is provided. The shoe closure mechanism includes a curved, shape returning, foot surround member with a central saddle back section positioned between two curved connecting ends, two pivoting closure arms each having an angled locking tooth extending from an undersurface thereof having an angled face and a perpendicular face and being connected together at the bottom ends thereof with a pivot assembly and each connected at a top end thereof to one curved connecting end of the curved foot surround member, and a locking mechanism that includes a spring biased locking bar having two sets of oppositely slanted teeth each positioned to engage one of the locking tooth of the pivoting closure arm, each set of slanted teeth being slanted such that the slanted surfaces face the angle face of its respective locking tooth allowing the closure arm to move toward a closed position; the top ends of the pivoting closure arms being forced together when the central saddle back portion is straightened; the locking mechanism disengaging the two locking teeth from the slanted teeth of the spring biased locking bar when a force is applied to a release button attached to the spring biased locking bar in a direction to move the spring biased locking bar away from the pivoting closure arms.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
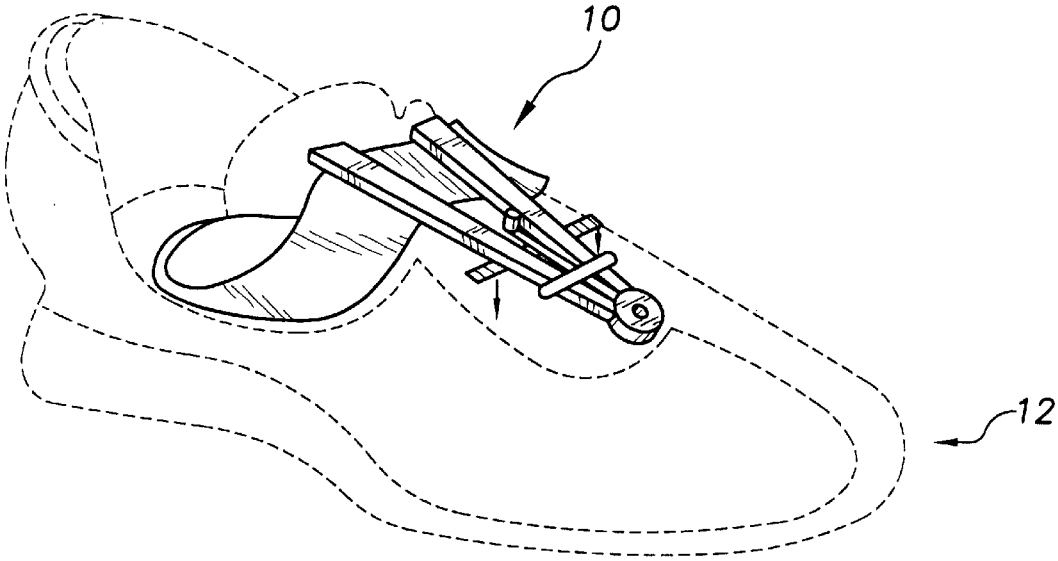
FIG. 1 is a perspective view of an exemplary embodiment of the shoe closure mechanism of the present invention installed within a representative athletic shoe.
Figure 2:
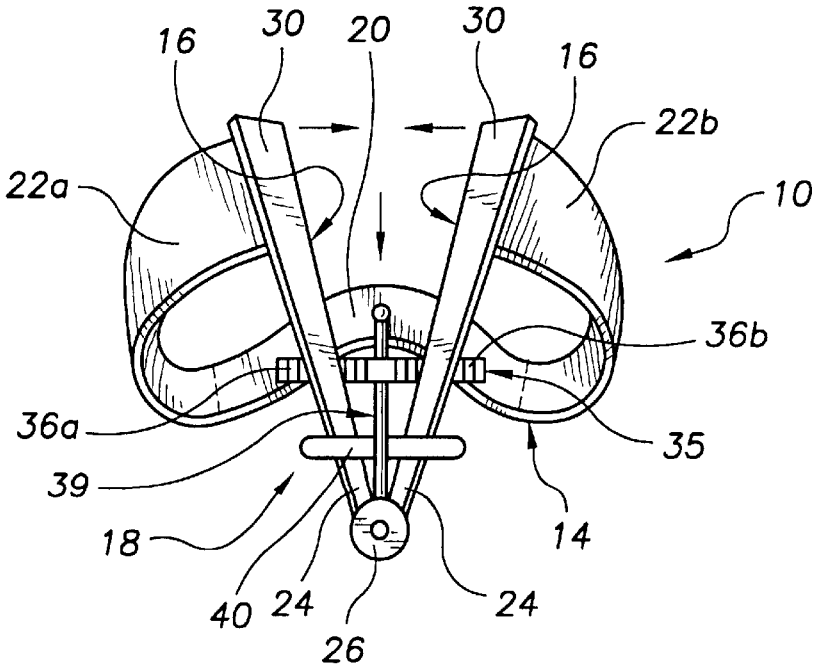
FIG. 2 is a perspective view of the exemplary shoe closure mechanism of FIG. 1 in isolation in the open configuration showing the curved foot surround member with the central saddle back section positioned between two curved connecting ends, the two pivoting closure arms connected together at the bottom with a pivot assembly and each connected at a top end to one end of the curved foot surround member; the top ends being forced together when the central saddle back portion is flattened by the weight of a user's foot; and the locking mechanism including the spring support bar, the spring biased locking bar, the spring member attached at a top portion thereof to the bottom of the spring biased locking bar, at a center portion thereof to the top of the spring support bar, at a bottom end portion thereof to the pivot assembly, and a release button attached to the end of the spring member above the spring biased locking bar.

FIG. 1 shows an exemplary embodiment of the shoe closure mechanism of the present invention, generally designated 10, installed within a representative athletic shoe, generally designated 12, shown in dashed lines. With reference to FIG. 2, shoe closure mechanism 10 includes a curved foot surround member, generally designated 14; two pivoting closure arms, each generally designated 16; and a locking mechanism, generally designated 18.

In this embodiment curved foot surround member 14 is of molded shape retaining plastic construction although other construction materials, such as metal, can be used with equal success. Curved foot surround member 14 includes a central saddle back section, designated 20 (shown between dashed lines) that is positioned between two curved connecting ends 22*a*,22*b*. The two pivoting closure arms 16 are of metal construction and are connected together at bottom ends 24 thereof by a pivot assembly 26. Pivoting closure arms 16 are each connected at a top end 30 to a respective curved connecting end 22*a*,22*b* of curved foot surround member 14.

Figure 3:
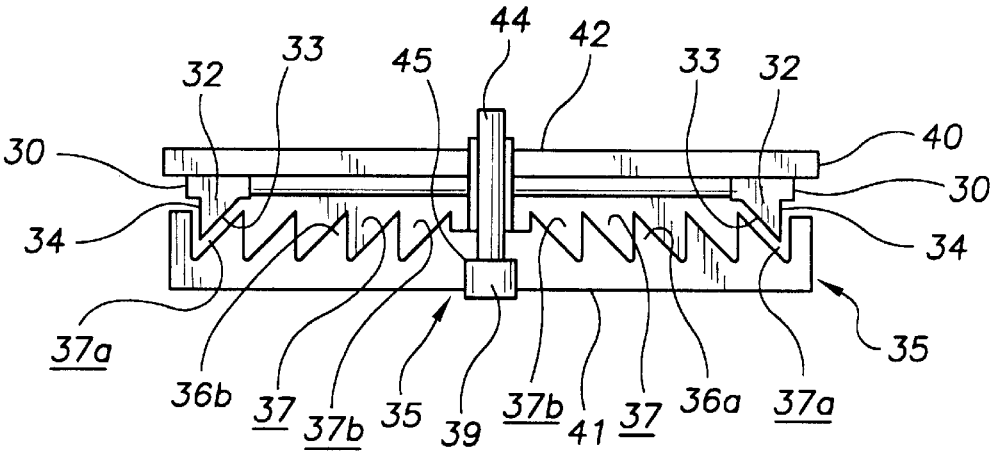
FIG. 3 is a plan view showing the two pivoting closure arms in the open position with the angled locking tooth of each closure arm seated within a respective outermost tooth receiving slot defined by a respective one of the two sets of slanted teeth of the spring biased locking bar, the spring member attached to the bottom of the spring biased locking bar and to the top of the spring support bar; and the release button attached to the end of the spring member.

With reference to FIG. 3, top ends 30 each have an angled locking tooth 32 extending from the undersurface thereof that each having an angled face 33 and a perpendicular face 34. Angled faces 33 are closer to each other than perpendicular faces 34. Referring back to FIG. 2, locking mechanism 18 includes a spring biased locking bar, generally designated 35; an elongated spring member, generally designated 39; and a spring support bar 40. Spring biased locking bar 35 has two sets of oppositely slanted teeth 36*a*,36*b* each positioned to engage a locking tooth 32 (FIG. 3) of a pivoting closure arm 16 and defining, referring now to FIG. 3, a number of tooth receiving slots 37 including an outermost tooth receiving slot 37*a* and an innermost tooth receiving slot 37*b*.

Spring member 39 is a length of spring steel attached to the bottom 41 of spring biased locking bar 35 and to the top 42 of spring support bar 40. A release button 44 is attached to the upper end 45 of spring member 39.

Figure 4:
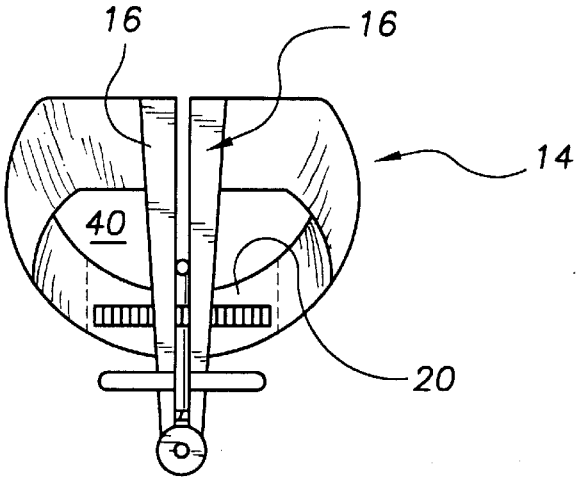
FIG. 4 is a perspective view of the shoe closure mechanism of FIG. 2 in the closed configuration showing the curved foot surround member with the central saddle back section pressed down, the two pivoting closure arms pivoted together and held there by the locking mechanism.
Figure 5:
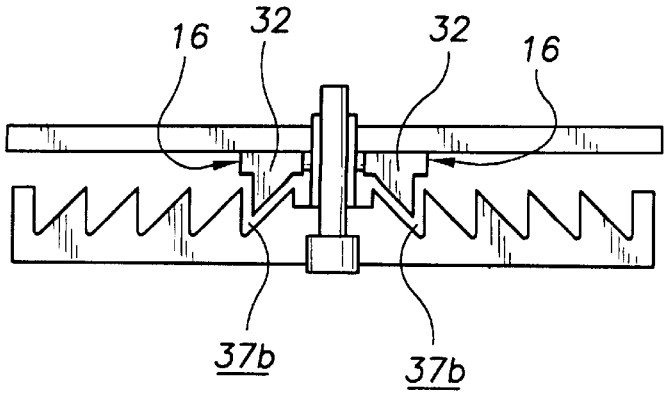
FIG. 5 is a plan view showing the two pivoting closure arms in the closed position with the angled locking tooth of each closure arm seated within a respective innermost tooth receiving slot defined by a respective one of the two sets of slanted teeth of the spring biased locking bar, the spring member attached to the bottom of the spring biased locking bar and to the top of the spring support bar; and the release button attached to the center of the spring member.

FIG. 4 shows the two pivoting closure arms 16 in the closed position with, referring now to FIG. 5, the angled locking tooth 32 of each closure arm 16 seated within a respective innermost tooth receiving slot 37*b* and, referring back to FIG. 4, central saddle back portion 20 flattened by the weight of a user's foot when the foot is inserted through the foot opening 40 defined by curved foot surround member 14.

It can be seen from the preceding description that a shoe closure mechanism has been provided that includes a mechanism for automatically closing closure arms to which the flaps of a shoe can be secured; that includes an easily operated locking mechanism for locking a pair of pivoting closure arms in a closed position; and that includes a curved, shape returning, foot surround member with a central saddle back section positioned between two curved connecting ends, two pivoting closure arms each having an angled locking tooth extending from an undersurface thereof having an angled face and a perpendicular face and being connected together at the bottom ends thereof with a pivot assembly and each connected at a top end thereof to one curved connecting end of the curved foot surround member, and a locking mechanism that includes a spring biased locking bar having two sets of oppositely slanted teeth each positioned to engage one of the locking tooth of the pivoting closure arm, each set of slanted teeth being slanted such that the slanted surfaces face the angle face of its respective locking tooth allowing the closure arm to move toward a closed position; the top ends of the pivoting closure arms being forced together when the central saddle back portion is straightened; the locking mechanism disengaging the two locking teeth from the slanted teeth of the spring biased locking bar when a force is applied to a release button attached to the spring biased locking bar in a direction to move the spring biased locking bar away from the pivoting closure arms.

It is noted that the embodiment of the shoe closure mechanism described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A shoe closure mechanism comprising:

a curved, shape returning, foot surround member with a central saddle back section positioned between two curved connecting ends;

two pivoting closure arms each having an angled locking tooth extending from an undersurface thereof having an angled face and a perpendicular face and being connected together at said bottom ends thereof with a pivot assembly and each connected at a top end thereof to one curved connecting end of said curved foot surround member; and a locking mechanism that includes a spring biased locking bar having two sets of oppositely slanted teeth each positioned to engage one of said locking tooth of said pivoting closure arm, each set of slanted teeth being slanted such that said slanted surfaces face said angle face of its respective locking tooth allowing said closure arm to move toward a closed position;

said top ends of said pivoting closure arms being forced together when said central saddle back portion is straightened;

said locking mechanism disengaging said two locking teeth from said slanted teeth of said spring biased locking bar when a force is applied to a release button attached to said spring biased locking bar in a direction to move said spring biased locking bar away from said pivoting closure arms.

* * * * *